United States Patent [19]

Bühler et al.

[11] Patent Number: 4,660,457

[45] Date of Patent: Apr. 28, 1987

[54] HOLDING APPARATUS FOR WEAPON BARRELS OF A MULTI-BARREL WEAPON

[75] Inventors: Ludwig Bühler, Dietikon; Bohler Erwin; Werner Bruderer, both of Zurich, all of Switzerland

[73] Assignee: Werkzeugmaschinenfabrik Oerlikon-Bührle AG, Zurich, Switzerland

[21] Appl. No.: 818,490

[22] Filed: Jan. 13, 1986

[30] Foreign Application Priority Data

Jan. 17, 1985 [CH] Switzerland ..... 206/85

[51] Int. Cl.[4] ..... F41D 7/04

[52] U.S. Cl. ..... 89/12; 89/1.41

[58] Field of Search ..... 89/12, 13.05, 13.1, 89/1.41

[56] References Cited

U.S. PATENT DOCUMENTS

| | | | |
|---|---|---|---|
| 1,311,860 | 7/1919 | Holzwarth | 89/1.41 |
| 1,334,983 | 3/1920 | Arter | 89/1.41 |
| 1,448,587 | 3/1923 | Arntzen | 89/1.41 |
| 3,897,714 | 8/1975 | Perrin et al. | 89/12 |
| 4,015,508 | 4/1977 | Blodgett et al. | 89/12 |
| 4,114,510 | 9/1978 | Prince et al. | 89/12 |
| 4,179,978 | 12/1979 | Kirkpatrick et al. | 89/12 |
| 4,259,891 | 4/1981 | Rosenzweig | 89/12 |

FOREIGN PATENT DOCUMENTS 117976 8/1918 United Kingdom .

*Primary Examiner*—David H. Brown

*Attorney, Agent, or Firm*—Werner W. Kleeman

[57] ABSTRACT

A plurality of, such as six weapon barrels are rotatively mounted about a central axis or shaft of a multi-barrel weapon, for example, a Gatling gun. In order to achieve a good target grouping the weapon barrels should be focused and twisted or curved. The weapon barrels are held in the desired position by a support apparatus. This support apparatus comprises a first adjustment element for the radial displacement of the weapon barrels with respect to the central axis or shaft of the weapon and a second adjustment element for the tangential displacement of the weapon barrels with respect to the central axis or shaft of the weapon.

4 Claims, 4 Drawing Figures

HOLDING APPARATUS FOR WEAPON BARRELS OF A MULTI-BARREL WEAPON

BACKGROUND OF THE INVENTION

The present invention relates to a new and improved construction of a holding apparatus for weapon barrels of a multi-barrel weapon.

In its more particular aspects, the present invention relates to a new and improved construction of a holding apparatus for weapon barrels of a multi-barrel weapon with components or elements for adjusting the positions of the weapon barrels relative to a central axis about which the weapon barrels rotate.

In a holding apparatus of this type, as known, for example, from U.S. Pat. No. 3,897,714 published Aug. 5, 1975, the distribution or scatter of the weapon barrels and the point of impact of the cartridges fired from the weapon barrels are controlled. This known holding apparatus is readily removably fastened at the front end of the weapon barrel, i.e. in the region of the weapon barrel muzzles, and comprises a perforated cylindrical clamping plate and a number of clamp straps with which the weapon barrels are secured in the desired position. The holding apparatus can be placed on the weapon barrel while all the bolts which are necessary for clamping are still loose and the clamp straps can subsequently be bolted up or tightened onto the clamping plate, whereby all the weapon barrels are locked in the desired position. Finally, a front plate is bolted to the cylindrical clamping plate.

Before discussing the disadvantages of this known holding apparatus, the construction of the multi-barrel weapon will be described so far as it is of interest in this connection. This type of multi-barrel weapon, e.g. a Gatling gun, possesses six weapon barrels which are arranged equidistantly to each other about a central axis of rotation. Originally all these six weapon barrels were arranged parallel to the axis of rotation and parallel to each other. However, it has been found that under certain circumstances it is necessary or advantageous to focus and twist or curve the weapon barrels. In other words the axes of the weapon barrels are not arranged on a cylindrical shell or surface but on a conical shell or surface, or even more preferably on a hyperboloid of one sheet. In order to achieve this the muzzles of the weapon barrels, on the one hand, are swiveled or deviated radially towards the central axis of rotation and, on the other hand, into tangential relationship with a circle whose middle or central point coincides with the central axis of rotation of the weapon. This focusing and twisting or curving of the weapon barrel makes possible an improvement of the target grouping. With this focusing it is achieved that all the weapon barrels are directed towards a single point, e.g. at a distance of 1–3 km. An equalization of the twisting or spinning effect is achieved with this twisting or curving of the weapon barrel, and this is necessary since the speed of rotation of the weapon barrel about the central axis can be very high and is also subject to fluctuations.

With the known holding apparatus the weapon barrels are, in fact, focused as well as twisted or curved but not independently of each other.

SUMMARY OF THE INVENTION

Therefore, with the foregoing in mind, it is a primary object of the present invention to provide a new and improved construction of a holding apparatus for weapon barrels of a multi-barrel weapon which does not exhibit the aforementioned drawbacks and shortcomings of the prior art construction.

Another and more specific object of the present invention aims at the provision of a new and improved construction of a holding apparatus for weapon barrels of a multi-barrel weapon in which the focusing and twisting or curving of the weapon barrels is individually possible for each weapon barrel.

Now in order to implement these and still further objects of the invention which will become more readily apparent as the description proceeds, the holding apparatus for weapon barrels of a multi-barrel weapon of the present invention is manifested by the features that there are provided a first adjusting element for the radial displacement of the weapon barrel with reference to the central axis of the weapon barrel and a second adjusting element for the tangential displacement of the weapon barrel with respect to the central axis of the weapon barrel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof only enough of the structure of the holding apparatus for weapon barrels of a multi-barrel weapon has been illustrated therein as is needed to enable one skilled in the art to readily understand the underlying principles and concepts of this invention. Turning now to the drawings, the apparatus illustrated therein by way of example and not limitation will be seen to comprise six weapon barrels 10 arranged about a central axis or shaft 11. These weapon barrels 10 belong to a here not particularly shown Gatling gun or cannon. When series or cadence firing of the Gatling gun takes place the six weapon barrels 10 rotate in the direction of the arrow A together with the central shaft 11. This rotation of the weapon barrels 10 has the effect that the projectiles fly away or follow their trajectories in a tangential direction away from the circle formed or defined by the six weapon barrels 10. The exit of a projectile from the weapon barrel 10 always takes place in the same position B (cf. FIGS. 2, 3 and 4) of the weapon barrel 10, i.e. every time one of the weapon barrels 10 arrives in the position B a projectile leaves the muzzle and, as already mentioned, flies or travels away in a tangential direction. The position B of the weapon barrel 10 in which the projectile exits from the muzzle is dependent on the speed of rotation of the weapon barrel 10 and the firing delay of the individual cartridge. Therefore the exit of the projectile from the muzzle can take place both somewhat before as well as somewhat after the weapon barrel 10 reaches the position B and this has the effect that the target grouping of the weapon deteriorates. In order to improve the target grouping the weapon barrels 10 are focused and twisted or curved. This means that the weapon barrels 10 are no longer parallel to the central axis or shaft 11. The distance of the weapon barrels 10 from the central axis or shaft 11 at the front of the weapon, that is at the muzzle of the weapon, is somewhat smaller than at the rear end of the weapon barrel 10. In this manner the distribution of the projectiles and the target grouping can be influenced.

Figure 1:
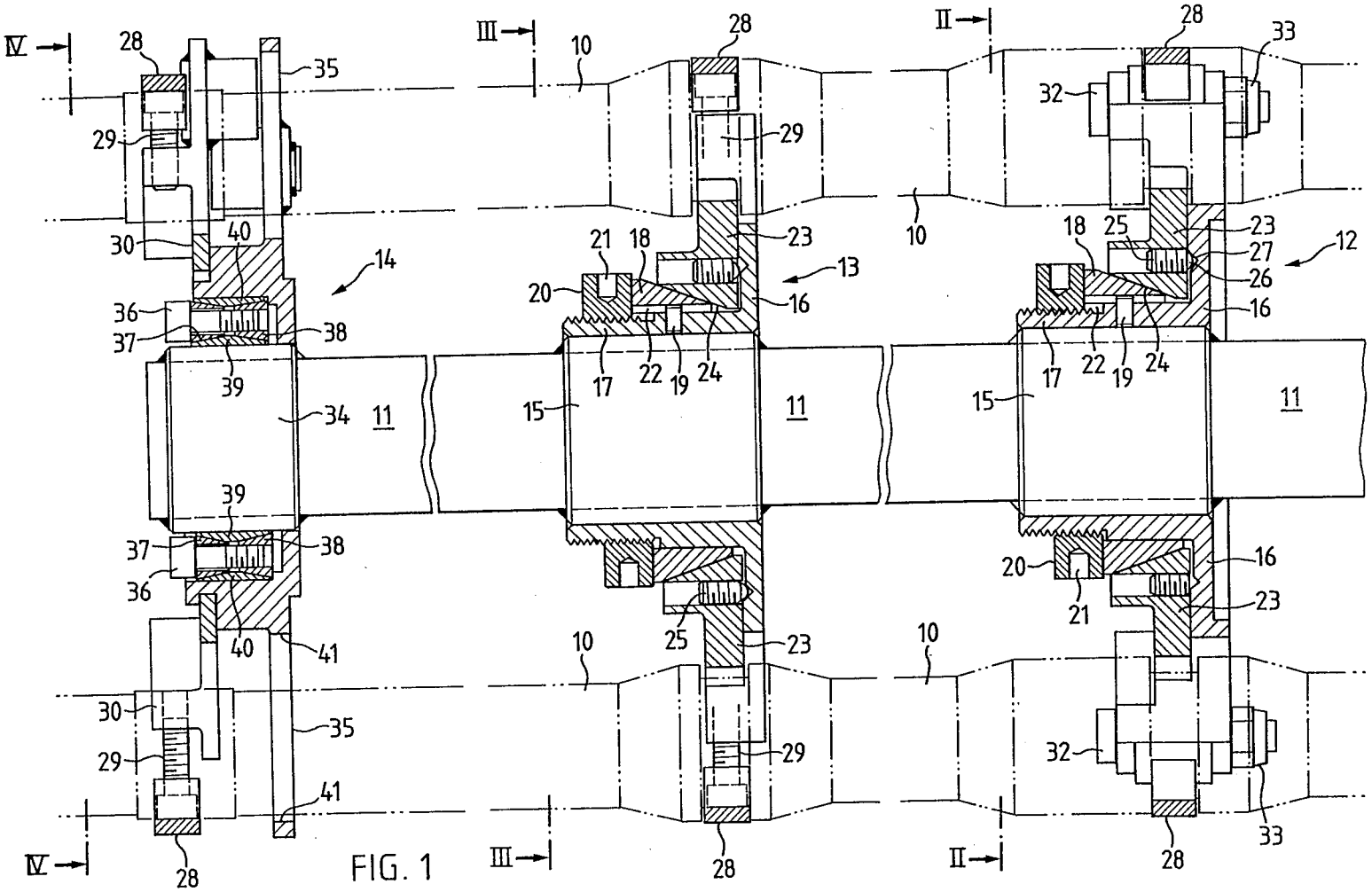
FIG. 1 schematically shows a longitudinal section through the complete tripartite barrel holding arrangement of an exemplary embodiment of a holding apparatus for weapon barrels of a multi-barrel weapon as applied to a Gatling gun.

As can be seen in FIG. 1, in order to be able to carry out this focusing and twisting or curving of the weapon barrels 10 there are provided three holding devices or adjusting or adjustment elements 12, 13 and 14. Of these three holding devices 12, 13 and 14 the first holding device 12 is arranged at the rear of the weapon barrel at the end away from the muzzle, the third holding device 14 is arranged at the front or muzzle end of the weapon barrel 10, and the second holding device 13 is arranged between the first holding device 12 and the third holding device 14.

Figure 2:
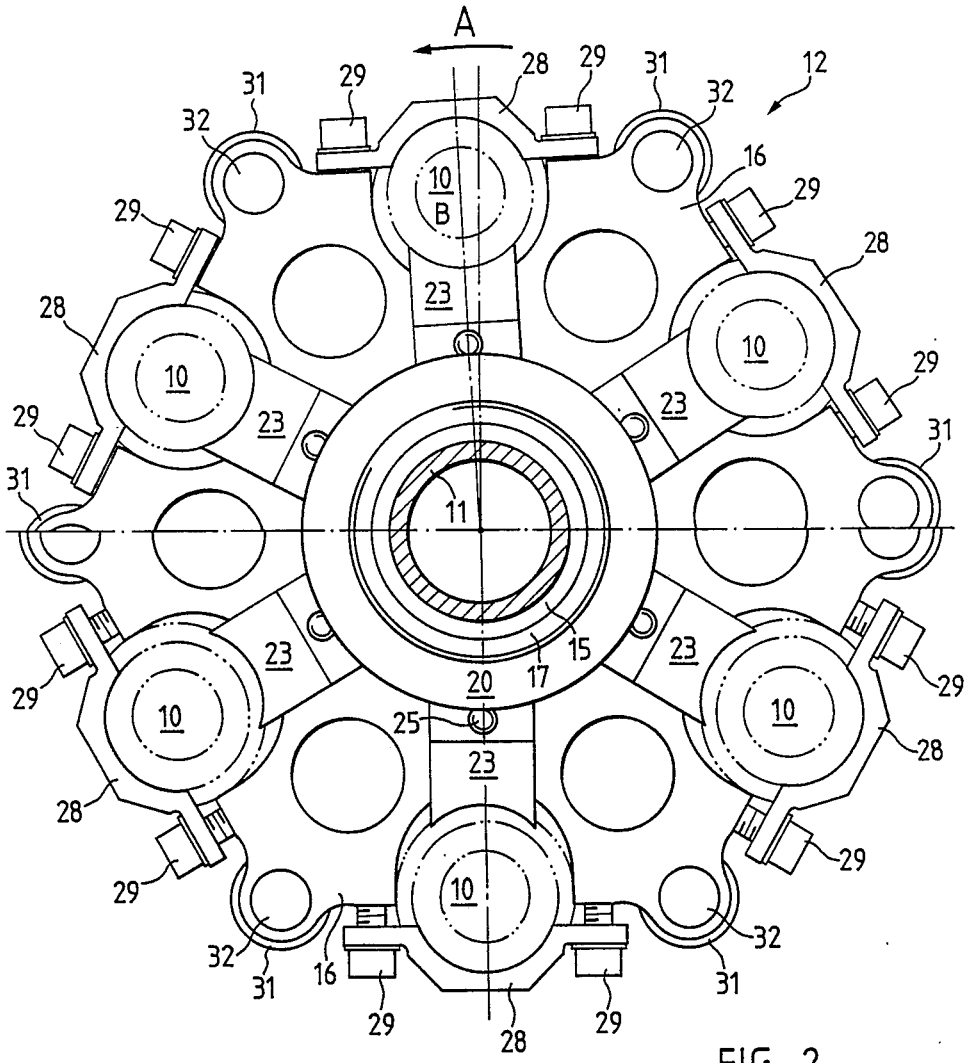
FIG. 2 schematically shows a section taken along the line II—II in FIG. 1.

In accordance with FIGS. 1 and 2 a sleeve 15 is welded or otherwise suitably mounted to the shaft 11. A disk 16 with a boss 17 is rotatably mounted on this sleeve 15. An annular ring 18 which in cross-section is substantially wedge-shaped or cuneiform is arranged so as to be axially displaceable on this boss 17 and is secured against rotation by means of a pin 19. A further annular threaded ring or ring member 20 serves for displacing the wedge-shaped annular ring 18, and this annular threaded ring 20 is threaded on an external or male thread of the boss 17 by means of its own internal or female thread. Radial bores or holes 21 enable the annular threaded ring 20 to be rotated on the boss 17 and thereby to axially displace the wedge-shaped annular ring 18. The pin 19 projects into an axial groove 21 of the wedge-shaped annular ring 18 and prevents the wedge-shaped annular ring 18 from turning when the annular threaded ring 20 is rotated. In FIG. 2 the annular ring 18 is not visible since it is situated behind the annular threaded ring 20. Six slides or slide members 23 are supported or rest on the wedge-shaped annular ring 18. These slides 23 each possess a curved hollow or recess against which the weapon barrel rests or abuts. The slides 23 and the weapon barrels 10 can be displaced by means of an axial displacement of the annular ring 18 due to the fact that the slides 23 each rest or abut with a slanting or beveled surface 24 against the wedge-shaped surface of the annular ring 18.

The slides 23 each possess a bolt or set screw 25 which is provided with a resiliently mounted ball or sphere 26 which in accordance with the top part of FIG. 1, can project into a coned recess or stop 27 of a disk 16 when the slide 23 is radially completely displaced towards the inside.

The components mentioned hereinbefore, which serve for the radial displacement of the six weapon barrels 10, are constructed exactly the same for both the first and the second holding devices 12 and 13. The foremost or front holding device 14 possesses no means for radial displacement of the weapon barrels 10. Each weapon barrel 10 is held in position on all of the holding devices 12, 13 and 14 by means of a yoke 28 or the like and two adjusting bolts 29 and, in accordance with FIGS. 2 and 3, each of the weapon barrels 10 is pressed against the slide 23 by means of this yoke 28. The adjusting bolts 29 are bolted onto disks 16 or 30. In order to carry out the radial displacement of the weapon barrel 10 the adjusting bolts 29 must first be loosened, as is shown in the lower half of the FIGS. 2 to 4. Thereupon the slides 23 can be radially displaced into the desired position by rotating the annular threaded ring 20. Only then may the adjusting screws 29 be tightened such that the weapon barrels are fixedly pressed or placed against the slide 23 by the yoke 28. With the assistance of the aforementioned components on the first and second holding devices 12 and 13, the weapon barrels 10 can be focused or moved by the desired amount with respect to the central axis or shaft 11. This means that the axes of the weapon barrels 10 are not parallel to the axis of the shaft 11 but are slanted by a desired angle such that the muzzles of the weapon barrels 10 are nearer to the cental axis or shaft 11 than the rear ends of the weapon barrels 10.

The weapon barrels 10 rotating with the central axis or shaft 11 are subject to a centrifugal force which has the tendency to press the weapon barrels 10 radially outwards. In order to prevent this radial displacement, the third holding device 14, as shown in FIG. 4, also possesses a yoke 28 for each weapon barrels 10 and this yoke is fastened by means of the adjusting bolts 29 to a disk 30 which is further described hereinbelow. However, the slides 23 are not provided in the holding device 14. In the upper half of FIGS. 2 to 4 the adjusting bolts 29 are screwed further into the yoke 28, into the position necessary for focusing the weapon barrels 10, and in the lower half of the FIGS. 2 to 4 the adjusting bolts 29 are shown still loose so as to permit the desired setting or adjustment of the slides 23.

In accordance with FIGS. 1 and 2 six rollers 31 are rotatably mounted on bolts 32 on the disk 16 of the first holding device 12, and these bolts 32 are secured by means of nuts 33. The purpose of these rollers 31 is to rotatably mount the six weapon barrels 10, with the three holding devices or components 12, 13 and 14, in a here not particularly shown housing of the weapon. As these rollers 31 are not subject matter of the present invention they are not further described here. Due to the fact that the rollers 31 are only provided on the first holding device 12 and not on the other two holding devices 13 and 14, the disk 16 of the middle or second holding device 13 is substantially simpler in construction than the disk 16 of the first holding device 12. Thus, the first and second holding devices 12 and 13 are differentiated only by these rollers 31.

In accordance with FIGS. 1 and 4 the third holding device 14 does not have the task of focussing the weapon barrels 10. This is only the task of the other two holding devices 12 and 13. The task of this third holding device 14 is to displace the weapons barrel 10 about the central axis or shaft 11, i.e. the weapon barrels 10 are displaced at their muzzles by an angle $\alpha$ while the rear ends of the weapon barrels maintain their positions. For this purpose the third holding device 14 is constructed as follows:

In accordance with FIGS. 1 and 4 a sleeve 34 is welded or otherwise suitably mounted onto the central axis or shaft 11. A disk 35 is secured against rotation on this sleeve 34 by means of a plurality of, such as fourteen bolts 36. The bolts 36 project through a first ring or ring member 37 and are threaded into a second ring or ring member 38. The two rings 37 and 38 surround an inner ring or ring member 39 and are surrounded in turn by an outer ring or ring member 40. The inner ring 39 abuts the sleeve 34 and the outer ring 40 abuts the disk 35. Due to the fact that the four rings 37 to 40 are wedge-shaped or conical in section the two rings 37 and 38 are displaced towards each other when the bolts 36 are tightened and are thereby pressed against the inner ring 39 and the outer ring 40. In this way the inner ring 39 is elastically or resiliently pressed against the sleeve 34 and the outer ring 40 is elastically or resiliently pressed against the disk 35. Thus, in this manner the disk 35 is rigidly connected with the central axis or shaft 11.

In accordance with FIGS. 1 and 4 the already mentioned disk 30 is rotatably mounted on the disk 35 which is rigidly secured or fastened on the central axis or shaft 11. The disk 35 possesses openings 41 through which the weapon barrels 10 project. The weapon barrels 10 are secured or fastened to the disk 30 by means of the yoke 28 and the adjusting bolts 29. Thus when the disk 30 rotates with respect to the disk 35 the weapon barrels 10 rotate through an angle $\alpha$ and also rotate with respect to the disk 35 and with respect to the central axis or shaft 11 through an angle which is not particularly shown in the drawing. The rear ends of the weapon barrels 10 do not move with respect to the central axis or shaft 11. Two arms or arm members 42 are provided at the disk 30 and two arms or arm member 43 are provided at the disk 35. Each arm 42 is connected to a related arm 43 by means of a bolt 44. The mutual spacing of the two arms 42 and 43 and therefore the angle $\alpha$ can be adjusted by means of these bolts 44. A number of, such as three bolts 45 project through elongated holes 46 of the disk 30 and are threaded into not particularly visible threaded holes of the disk 35. By means of these screws the positional relationship of the disks 30 and 35 to each other can be locked. There is depicted in the upper half of FIG. 4 the largest angle $\alpha$ and in the lower half of FIG. 4 the smallest angle $\alpha$ as can be seen by the position of the elongated holes 46 with respect to the bolts 45.

From the above-mentioned description of the inventive holding apparatus for weapon barrels there results the following method of operation:

In the starting or initial position the axes of the weapon barrels 11 are situated on a cylindrical shell or surface, whereby the axis of the shaft 11 is arranged concentric to the axis of the cylinder, i.e. the two axes coincide. Due to a purely focusing action of the weapon barrels 10 the axes of the weapon barrels 10 are arranged on a conical shell or surface. Due to a purely twisting or curving action of the weapon barrels 10 the axes of the weapon barrels 10 are arranged on a surface of a hyperboloid of one sheet.

It is assumed that the rear ends of the weapon barrels 10, which are not particularly shown in the drawing, are rigidly clamped in a weapon housing, which is also not here particularly shown, and take up the hereinbefore described initial position without the hereinbefore described holding apparatus, i.e. they are arranged parallel to the central axis or shaft 11 and parallel to each other.

Figure 3:
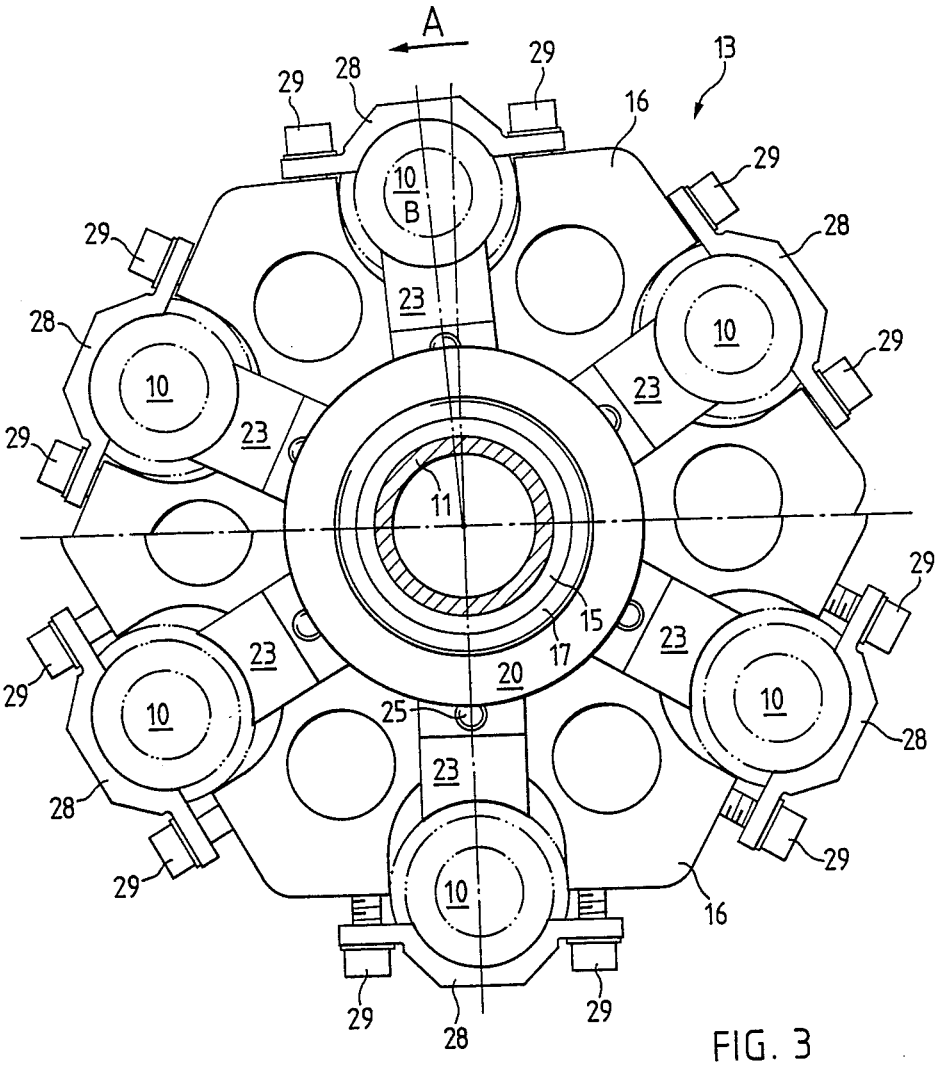
FIG. 3 schematically shows a section taken along the line III—III in FIG. 1.
Figure 4:
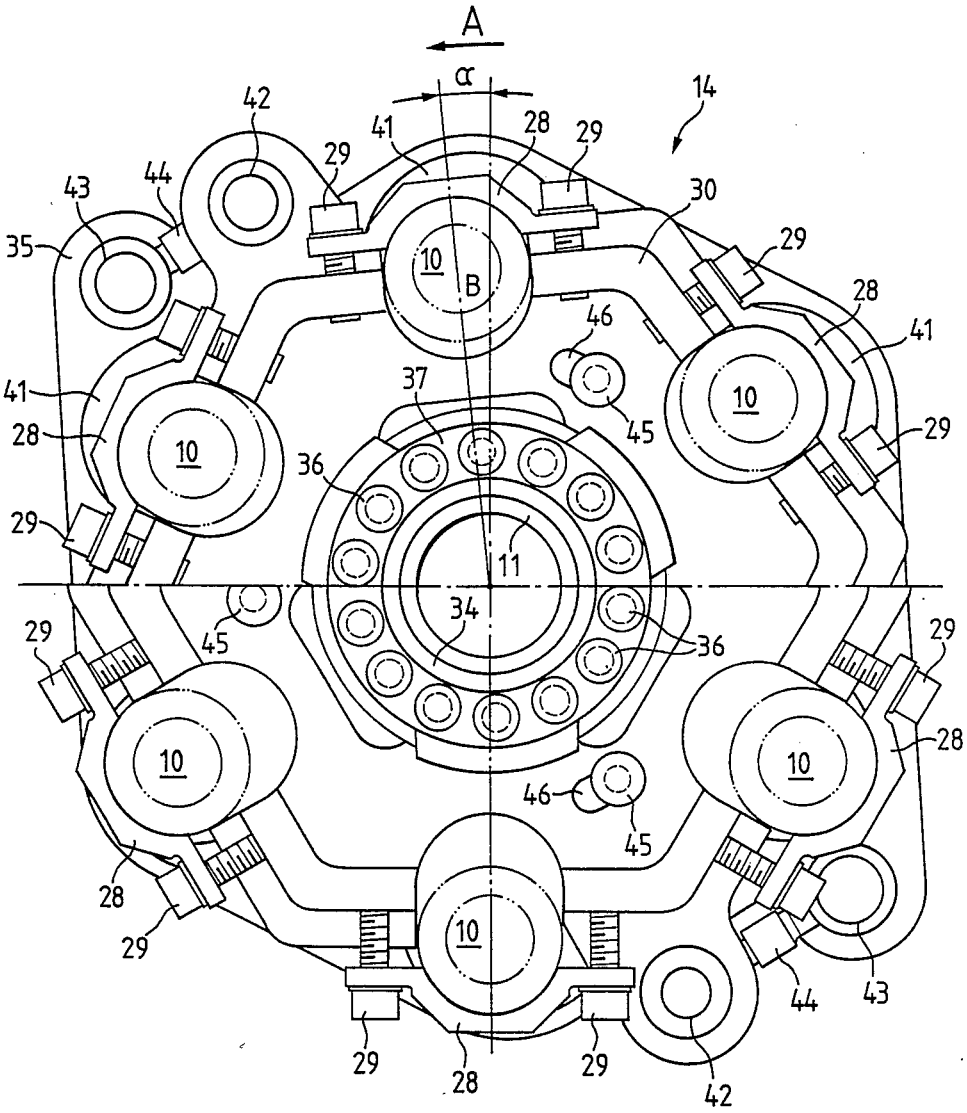
FIG. 4 schematically shows a section taken along the line IV—IV in FIG. 1.

The three holding devices 12, 13 and 14 are now placed or positioned upon the central axis or shaft 11 and the weapon barrels 10 in the manner shown in FIG. 1 with the adjusting bolts 29 for fastening the yokes 28 loosened as shown in the lower halves of the FIGS. 2 to 4.

After the calculation of the amount of the required focusing and twisting or curving, the weapon barrels 11 can now be flexibly displaced out of the above-mentioned initial position in that the adjusting bolts 29 for the yokes 28 of the three holding devices 12, 13 and 14 of the holding apparatus are tightened. At the same time the slides 23 must also be radially displaced into the desired position by rotation of the annular threaded rings 20, as can be seen in FIG. 1 and, also at the same time, the disk 30 must be displaced relative to the disk 35 (FIG. 4) by the desired angle $\alpha$ by turning the bolts 44. Finally, the bolts 45 are tightened and the two disks 30 and 35 are secured to each other.

While there are shown and described present preferred embodiments of the invention, it is to be distinctly understood that the invention is not limited thereto, but may be otherwise variously embodied and practiced within the scope of the following claims.

Accordingly, what we claim is:

1. A holding apparatus for weapon barrels of a multibarrel weapon having a central shaft, comprising:

at least one adjusting element for displacing said weapon barrels with respect to said central shaft; and said at least one adjusting element comprising a first adjusting element for radially displacing all of said weapon barrels conjointly relative to said central shaft and a second adjusting element for tangentially displacing all of said weapon barrels conjointly relative to said central shaft.

2. A holding apparatus for weapon barrels of a multibarrel weapon having a central shaft, comprising:

at least one adjusting element for radially displacing said weapon barrels with respect to said central shaft;

said at least one adjusting element comprising a first adjusting element for radially displacing said weapon barrels relative to said central shaft and a second adjusting element for tangentially displacing said weapon barrels relative to said central shaft;

said at least one first adjusting element comprising radially arranged adjusting bolts; and said at least one second adjusting element comprising tangentially arranged adjusting bolts.

3. The holding apparatus as defined in claim 2, wherein:

said at least one first adjusting element comprises an annular ring arranged on said central shaft;

said annular ring being axially displaceable and possessing a substantially conical surface;

a slide for each weapon barrel of said weapon barrels and for each said at least one first and at least one second adjusting element;

said slide possessing a substantially wedge-shaped cross-section and being radially displaceable, supported on said conical surface and abutting said weapon barrel; and threaded means for axially displacing said annular ring such that said weapon barrels of said weapon are uniformly radially displaceable.

4. The holding apparatus as defined in claim 2, wherein:

said at least one second adjusting element comprises a first disk rigidly connected with said central shaft;

said weapon barrels having muzzles;

a second disk rigidly connected to said weapon barrels proximate to said muzzles of said weapon barrels of said weapon;

said first disk being rotatably displaceable relative to said second disk about said central shaft;

a tangentially oriented bolt hinged to said first disk and said second disk; and said first disk and said second disk being connected by said bolt for displacing said first disk relative to said second disk.

* * * * *